US009017233B2

(12) United States Patent
Tai et al.

(10) Patent No.: US 9,017,233 B2
(45) Date of Patent: Apr. 28, 2015

(54) WATER RESISTANCE LOWER BODY RECIPROCATING EXERCISER

(71) Applicant: Southern Taiwan University of Science and Technology, Tainan (TW)

(72) Inventors: Tzu-Yao Tai, Tainan (TW); Cheng-Yu Kuo, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 98 days.

(21) Appl. No.: 14/035,120

(22) Filed: Sep. 24, 2013

(65) Prior Publication Data

US 2015/0087482 A1 Mar. 26, 2015

(51) Int. Cl.

*A63B 22/06* (2006.01)
*A63B 22/00* (2006.01)
*A63B 24/00* (2006.01)

(52) U.S. Cl.

CPC ..... *A63B 22/0694* (2013.01); *A63B 22/0015* (2013.01); *A63B 24/0062* (2013.01)

(58) Field of Classification Search

CPC ..... A63B 24/00; A63B 22/001; A63B 2022/002; A63B 2022/067; A63B 21/225; A63B 2220/30; A63B 2230/06; A63B 22/0664; A63B 2022/0017; A63B 21/0053; A63B 21/0058; A63B 2220/36; A63B 2225/096; A63B 22/0015; A63B 21/0083

USPC ..... 482/111–113, 51–53

See application file for complete search history.

(56) References Cited

U.S. PATENT DOCUMENTS

| | | | | |
|---|---|---|---|---|
| 3,976,057 | A * | 8/1976 | Barclay | 601/34 |
| 4,151,839 | A * | 5/1979 | Schwarz | 601/104 |
| 4,733,858 | A * | 3/1988 | Lan | 482/53 |
| 5,046,484 | A * | 9/1991 | Bassett et al. | 601/24 |
| 5,114,389 | A * | 5/1992 | Brentham | 482/53 |
| 5,129,450 | A * | 7/1992 | Hung | 165/168 |
| 5,490,818 | A * | 2/1996 | Haber et al. | 482/52 |
| 5,890,996 | A * | 4/1999 | Frame et al. | 482/8 |
| 6,679,812 | B2 * | 1/2004 | Torkelson | 482/51 |
| 7,399,259 | B2 * | 7/2008 | Somwong | 482/57 |
| 2014/0249003 | A1 * | 9/2014 | Tai et al. | 482/111 |

FOREIGN PATENT DOCUMENTS

| | | |
|---|---|---|
| TW | 383592 | 8/1987 |
| TW | M398439 U1 | 2/2011 |
| TW | M424170 U1 | 3/2012 |
| TW | M443555 U1 | 12/2012 |

* cited by examiner

*Primary Examiner* — Stephen Crow

(74) *Attorney, Agent, or Firm* — Rosenberg, Klein & Lee

(57) ABSTRACT

A lower body reciprocating exerciser includes a frame having two posts on two sides thereof. Two swing units are respectively connected to the two posts and an arm of each swing unit is connected with a cam of a transmission unit corresponding thereto. The cam is connected with a piston rod of a resistance unit corresponding thereto and the piston rod is connected with a piston located in a cylinder. An enclosed loop pipe is connected to outside of each of the cylinders and includes two sets of a check valve and an adjustable control valve. The loop pipe communicates with the space in the cylinder. The check valves and the adjustable control valves control the fluid in the cylinders to adjust the resistance force when the user swings the pedals and the arms, so that the user's bones and muscles of the lower body are exercised properly.

10 Claims, 7 Drawing Sheets

WATER RESISTANCE LOWER BODY RECIPROCATING EXERCISER

BACKGROUND OF THE INVENTION

1. Fields of the Invention

The present invention relates to an exerciser, and more particularly, to a lower upper body reciprocating exerciser by using water resistance and cam to exercise the muscles of the lower body.

2. Description of Related Art

Along with more and more modern cities development and with the changes in life style, people do not have time to take exercises or do not have the habit to exercise, the muscles and bones are dramatically weakened so that the health condition becomes a severe concern especially for aged or retained people. There are different exercisers provided to help people to reinforce the muscles and bones.

Taiwan Utility Model No. M443555 and M398439 disclose a twist exerciser to help a user to exercise the lower body. Taiwan Utility Model No. M443555 comprises two rotatable members with two pedals connected thereto and the rotatable member is pivoted back and forth so that the user alternatively moves/slides his/her legs so as to exercise the lower body. Taiwan Utility Model No. M398439 comprises two curved rails and the pedals are slidable on the curved rails back and forth. By the action, the lower body is twist and moved so as to be exercised. However, there is no proper resistance to be overcome during the exercising, so that the muscles do not properly exercised and the result is not satisfied.

Accordingly, the Taiwan Utility Model No. M424170 and M383592 further add weights or hydraulic cylinders to provide the resistance. Taiwan Utility Model No. M424170 comprises multiple weights cooperated with a slide member to perform as a resistance unit, and Taiwan Utility Model No. M383592 uses two cylinders to perform as the resistance unit, and the hydraulic pressure of the two cylinders can be adjusted so as to provide desired resistance. Nevertheless, the use of weights cannot be adjusted and some of the users who have weak muscles such as aged people may be injured. Besides, the weights can be oxidized, rusted or even stolen if they are put in outdoor sites. The use of the hydraulic cylinders may have leakage problems and the hydraulic oil may contaminate the environment.

The present invention intends to provide a lower body reciprocating exerciser by using water resistance and cam to exercise the muscles of the lower body, the exerciser of the present invention improves the shortcomings mentioned above.

SUMMARY OF THE INVENTION

The present invention relates to a lower body reciprocating exerciser, and comprises a frame having two posts on two sides thereof. Two transmission units each have a cam which is a disk cam. A guide slot is defined in a first face of the cam and a passive member is located in the guide slot. The passive member is connected with a first end of a piston rod. A piston is connected to a second end of the piston rod. A shaft extends through the cam and is connected to the post corresponding thereto. Two resistance units are connected to the two transmission units respectively. Each of the resistance units has a cylinder which has a space defined therein. The piston and the piston rod are located in the space of the cylinder corresponding thereto. The piston divides the space into a top room and a bottom room. An enclosed loop pipe is connected to outside of each of the cylinders. A top pipe is connected between the top portion of the loop pipe and the top room of the cylinder. A bottom pipe is connected between the lower portion of the loop pipe and the bottom room of the cylinder. The loop pipe has a down-flow section and an up-flow section. Each of the down-flow section and the up-flow section has a check valve and an adjustable control valve. The check valve in the down-flow section and the check valve in the up-flow section are installed in opposite directions. Water is filled in the space of the cylinder. Two swing units each have a pedal and an arm, wherein the pedal is connected to the lower end of the arm. The top end of the arm is pivotably connected to the first end of the shaft of the transmission unit at the post corresponding thereto.

Preferably, the piston of each resistance unit has multiple paths defined therethrough.

Preferably, each of the cams has a restriction slot defined in the second face thereof which is located in opposite to the first face. A pin is connected to the post and inserted into the restriction slot.

Preferably, an angle of 116 degrees is defined between two extensions of the restriction slot which is a curved slot.

Preferably, the frame has a base and two side frames are connected to two sides of the base. The two posts respectively extend from the two sides of the base. Two installation units are respectively connected to the top end of the post and the top end of the side frame on each of the two sides of the base. Each installation unit has a connection slot and the cam of the transmission unit is located in the connection slot. A passage is defined through each of the installation units and communicates with the connection slot. The shaft extends through the passage and the cam. A stop is connected to the second end of the shaft. The first end of the shaft is connected to the top end of the arm of the swing unit corresponding thereto. The installation unit has an insertion hole defined in the outer face thereof and the insertion hole communicates with the connection slot. The pin in the restriction slot of the cam is inserted into the insertion hole of the installation unit.

Preferably, a handle is connected between the two side frames.

The cam of the exerciser is cooperated with the check valves and the adjustable control valves in the loop pipe of the cylinder to control the direction and volume of the water in the cylinder to ensure that when the cam drives the piston rod, the piston is moved in the cylinder to generate proper pressure so as to provide the resistance in opposite direction to the force from the user so as to exercise the muscles and bones of the users.

The present invention uses water as the source of resistance of the exerciser and water is less expensive than hydraulic fluid. Even if the water leaks, it is not harmful to the environment so that the present invention is suitable to be set in public areas such as parks.

The cams of the present invention each have a restriction slot and the pin is inserted in the restriction slot. When the user swings the pedals alternatively, the restriction slot cooperates with the pin to restrict the angle that the shaft rotates so as to protect the user from injury by overly swinging the swing units.

Each of the pistons has multiple paths defined therethrough so that when the pistons move to push the fluid, the fluid flows between the top and bottom rooms via the paths. The paths in the pistons make the fluid to move smoothly and protect the cylinders from being damaged by pressure.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
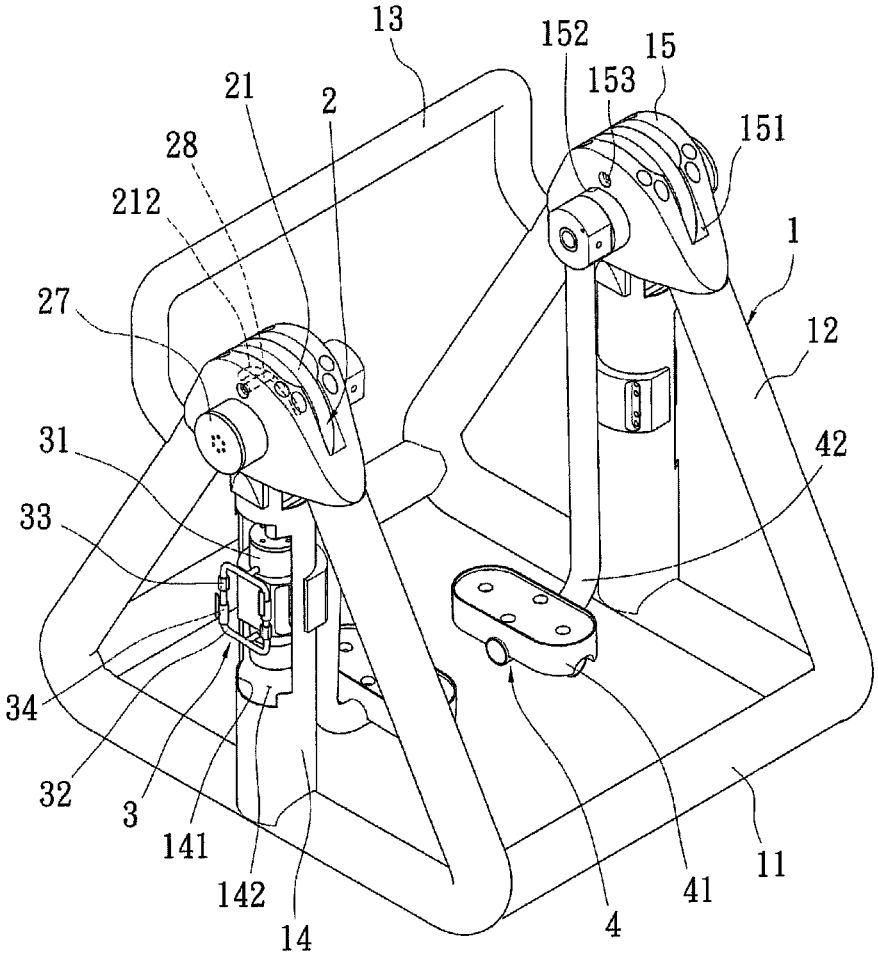
FIG. 1 is a perspective view to show the lower body reciprocating exerciser of the present invention.
Figure 2:
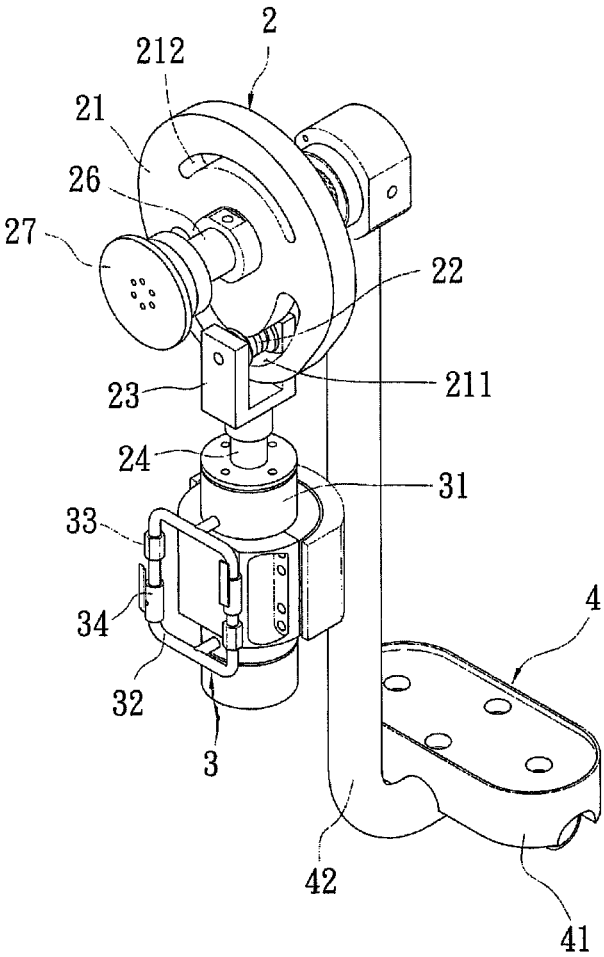
FIG. 2 is an enlarged perspective view to show a portion of the lower body reciprocating exerciser of the present invention.

Referring to FIGS. 1 and 2, the lower body reciprocating exerciser of the present invention comprises a frame 1, two transmission units 2, two resistance units 3 and two swing units 4. The two transmission units 2, the two resistance units 3 and the two swing units 4 are respectively connected to the two sides of the frame 1.

The frame 1 has a base 11 and two side frames 12 are connected to two sides of the base 11. A handle 13 is connected between the two side frames 12. The structure on the two sides of the base 11 of the frame 1 are identical so that only the structure of one side is described, the structure of the other side will be clear without further description.

A post 14 extends from one side of the base 11 and located within the side frame 12. The post 14 of the frame 1 is a hollow post and has a space 142 defined therein. An opening 141 is defined through a wall of the posts 14 and communicates with the space 142 of the post 14. An installation unit 15 is connected to the top end of the post 14 and the top end of the side frame 12. The installation unit 15 has a connection slot 151 and a cam 21 of the transmission unit 2 is located in the connection slot 151. A passage 152 is defined through the installation unit 15 and communicates with the connection slot 151. An insertion hole 153 is defined in the outer face thereof and located above the passage 152, the insertion hole 153 communicates with the connection slot 151.

The transmission unit 2 has the cam 21 which is a disk cam. A guide slot 211 defined in a first face of the cam 21 and a passive member 22 is located in the guide slot 211. The guide slot 211 is shaped as a semi-oval curve. The passive member 22 is a roller which is connected with a fork 23. The first end of a piston rod 24 is connected to the fork 23 and a piston 25 is connected to the second end of the piston rod 24. The fork 23, the piston 25 and the piston rod 24 are located in the space 142 of the post 14. A shaft 26 extends through the center of the cam 21 and the passage 152 of the installation unit 15. The first end of the shaft 26 is connected to the top end of an arm 42 of the swing unit 4 corresponding thereto. A stop 27 is connected to the second end of the shaft 26. The cam 21 has a restriction slot 212 defined in the second face thereof which is located in opposite to the first face. An angle of 11- to 120 degrees is defined between the two extensions of the restriction slot 212, preferably, the angle is 116 degrees. The insertion hole 153 is located corresponding to the restriction slot 212. A pin 28 is connected to the post 14 and inserted into the restriction slot 212.

Figure 3:
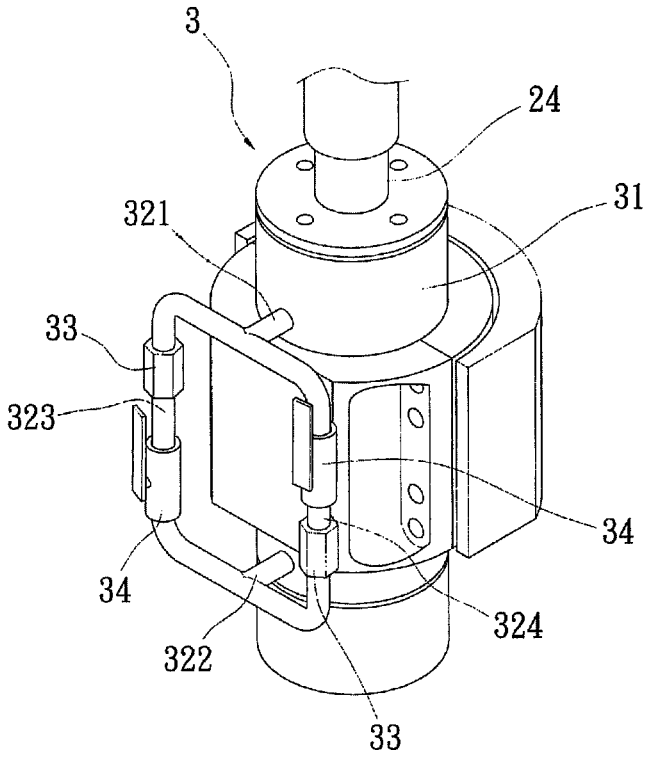
FIG. 3 is an enlarged perspective view to show the resistance unit of the lower body reciprocating exerciser of the present invention.
Figure 5:
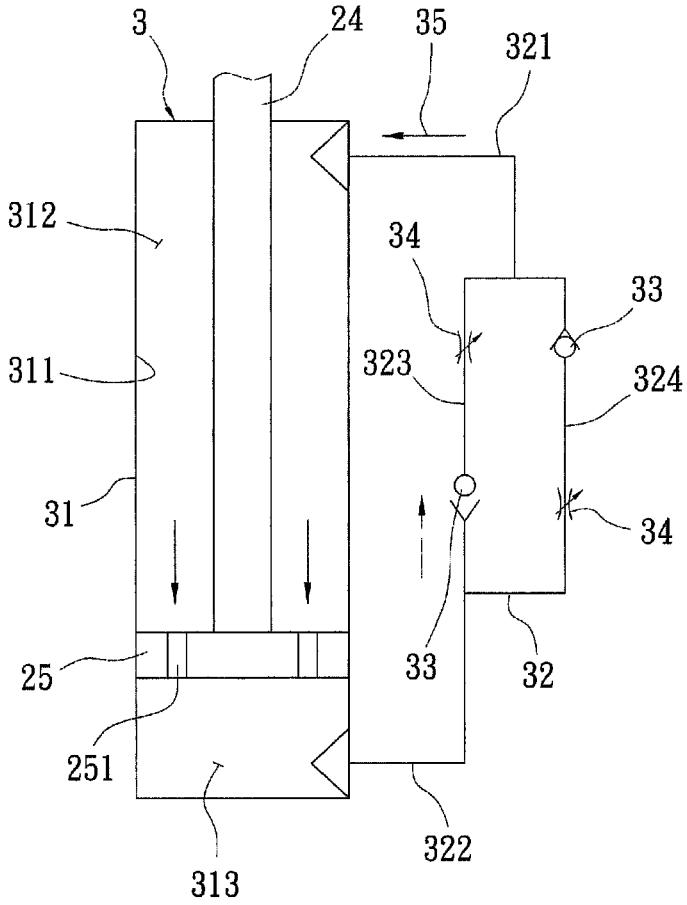
FIG. 5 shows the water flowing path when the piston moves downward.

As shown in FIGS. 3 and 5, the resistance unit 3 is located corresponding to the transmission unit 2. The resistance unit 3 has a cylinder 31 which has a space 311 defined therein, and the cylinder 31 is located in the space 142 of the post 14 and located at the opening 141. The piston 25 and the piston rod 24 are located in the space 311 of the cylinder 31. The piston 25 divides the space 311 into a top room 312 and a bottom room 313. The piston 25 has multiple paths 251 defined therethrough. An enclosed loop pipe 32 is connected to outside of each of the cylinders 31. A top pipe 321 is connected between the top portion of the loop pipe 32 and the top room 312 of the cylinder 31. A bottom pipe 322 is connected between the lower portion of the loop pipe 32 and the bottom room 313 of the cylinder 31. The loop pipe 32 has a down-flow section 323 and an up-flow section 324 on two sides thereof. Each of the down-flow section 323 and the up-flow section 324 has a check valve 33 and an adjustable control valve 34. The check valve 33 and the adjustable control valve 34 in the down-flow section 323 of the resistance unit 3 are arranged such that the check valve 33 is located above the adjustable control valve 34. The check valve 33 and the adjustable control valve 34 in the up-flow section 324 of the resistance units 3 are arranged such that the adjustable control valve 34 is located above the check valve 33. The check valve 33 in the down-flow section 323 and the check valve 33 in the up-flow section 324 are installed in opposite directions. Fluid is filled in the space 311 of the cylinder 31 and the fluid is water.

The swing unit 4 has a pedal 41 and the arm 42, wherein the pedal 41 connected to the lower end of the arm 42. The top end of the arm 42 is pivotably connected to the first end of the shaft 26 of the transmission unit 2 at the post 14.

The exerciser of the present invention can be installed to outdoor sites such as parks so that the peoples such as elders can easily use the exerciser. The rectangular base 11 of the frame 1 is suitable for installing the exerciser to the ground of the parks.

Figure 4:
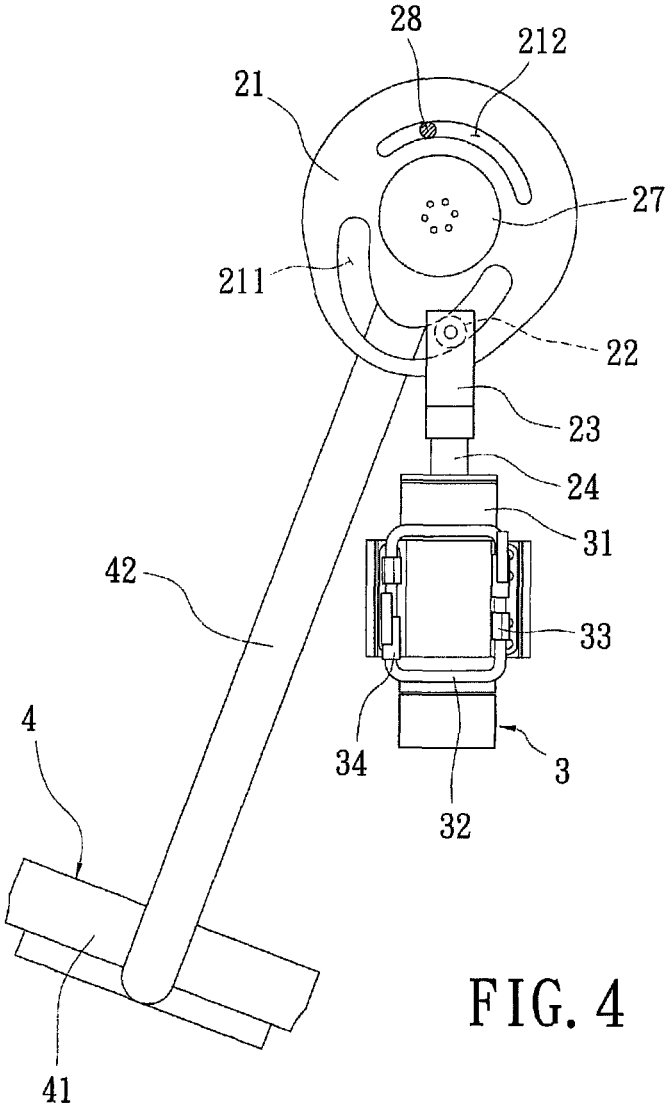
FIG. 4 shows that one of the two arms of the lower body reciprocating exerciser of the present invention swings forward by a user.

When in use, as shown in FIG. 4, the user stands on the two pedals 41 of the swing units 4 and the hands hold the handle 13 between the two side frames 12. The two legs of the user swings alternatively naturally to swing the arms 42 which rotate the shaft 26 of the transmission units 2. When the arm 42 swings forward, the shaft 26 drives the cam 21 to rotate clockwise and the passive member 22 in the guide slot 211 moves from one end of the guide slot 211 to the other end. The passive member 22 moves upward from one end of the guide slot 211 and passes through the peak point of the guide slot 211 and then reaches the other end of the guide slot 211.

When the passive member 22 moves upward in the guide slot 211, as shown in FIG. 5, the piston rod 24 is driven by the fork 23 and the piston 25 is moved from the top room 312 to the bottom room 313 in the space 311 of the cylinder 31. The fluid 35 in the space 311 is pushed when the piston 25 is moved from the top room 312 to the bottom room 313 so that the fluid 35 generates resistance relative to the piston 25. Therefore, the user's muscles and bones of the lower body are exercised when the arm 42 is pivoted forward.

When the piston 25 is moved from the top room 312 to the bottom room 313 in the space 311 of the cylinder 31, the fluid 35 in the bottom room 313 is pushed by the piston 25 and flows into the loop pip 32 via the bottom pipe 322. Because the check valve 33 and the difference of pressure in the loop pipe 32, the fluid 35 passes through the check valve 33 of the flow-down section 323 and enters into the top room 312 of the space 311 of the cylinder 31 via the top pipe 321. When the passive member 22 passes through the peak point of the guide slot 211, the piston 25 reaches the lowest point in the bottom room 313 of the space 311 of the cylinder 31. Besides, when the piston 25 pushes the fluid 35, the fluid 35 passes through the paths 251 of the piston 25 and flows to the top room 312 via the bottom room 313. Therefore, by the paths 251, the volume of the fluid 35 that pass through the piston 25 is increased. The fluid 35 moves smoothly and prevents the cylinder 31 from being damaged by high pressure.

Figure 6:
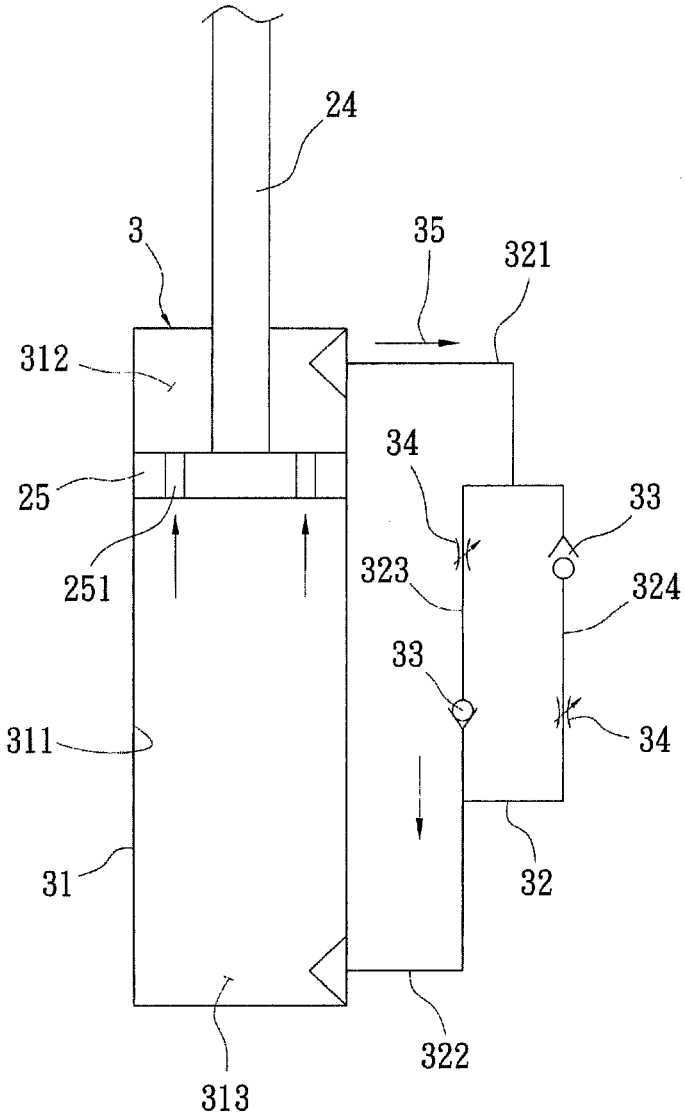
FIG. 6 shows the water flowing path when the piston moves upward.

Referring to FIG. 6, when the passive member 22 passes over the peak point of the guide slot 211, the passive member 22 starts to move backward, the passive member 22 and the piston 25 are not restricted by the guide slot 211, and the fluid 35 in the top room 312 of the space 311 of the cylinder 31, affected by the difference of pressure, flows through the top pipe 321, the check valve 33 of the up-flow section 324 of the loop pipe 32, the bottom pipe 322 and then flows into the bottom room 313 which has lower pressure, until a pressure balance is reached between the top room 312 and the bottom room 313 in the space 311 of the cylinder 31. When the fluid 35 flows back into the bottom room 313, the piston 25 is pushed upward by the fluid 35 in the bottom room 313. When the pressure balance is reached between the top room 312 and the bottom room 313 in the space 311 of the cylinder 31, the piston 25 moves back to its initial position.

Figure 7:
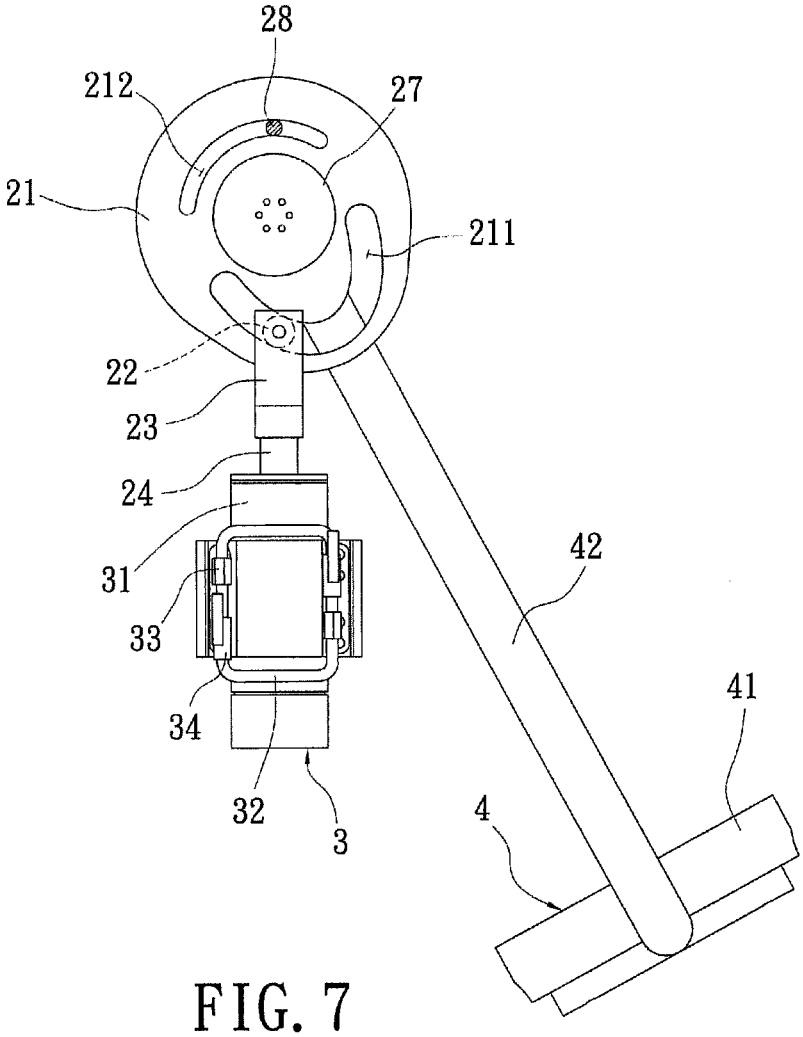
FIG. 7 shows that one of the two arms of the lower body reciprocating exerciser of the present invention swings backward by the user.

Furthermore, when the user moves the arm 42 and the pedal 41 backward, as shown in FIG. 7, the arm 42 drives the shaft 26 to rotate counter clockwise and the disk 21 is rotated counter clockwise. The passive member 22 in the guide slot 211 moves from one end to the other end of the guide slot 211. When the passive member 22 in the guide slot 211 moves from one end to the other end of the guide slot 211, the resistance unit 3 is repeatedly operated to generate resistance to exercise the muscles and bones of the other leg of the lower body of the user.

When the user operates the pedals 41 and the arms 42 to rotate the shaft 26 in two opposite directions, the restriction slot 212 of the cam 21 is cooperated with the pin 28 to restrict the cam 21 to be rotated between positive and negative 58 degrees. In other words, the arms 42 that are connected to the cams 21 and the shafts 26 are restricted to be pivoted between positive and negative 58 degrees. By this arrangement, the user is not injured by overly pulling the legs.

When the user wants to adjust the resistance from the resistance unit 3, the resistance can be increased by reducing the volume of the fluid 35 passing through the adjustable control valve 34, vice versa. The operation of the adjustable control valve 34 changes the area that the fluid 35 passes so as to obtain desired resistance. By this specific feature, different users can operate the exerciser of the present invention with proper resistance by adjusting the adjustable control valve 34 so as to avoid injury. The fluid 35 used in the exerciser of the present invention is water, so that even when the fluid 35 leaks, the water is not harmful to the environment of the parks.

The present invention has the following advantages:

The cam 21 of the exerciser is cooperated with the check valves 33 and the adjustable control valves 34 in the loop pipe 32 of the cylinder 31 to control the direction and volume of the water in the cylinder 31 to ensure that when the cam 21 drives the piston rod 24, the piston 25 is moved in the cylinder 31 to generate proper pressure so as to provide the resistance in opposite direction to the applied force from the user so as to exercise the muscles and bones of the users.

The present invention uses water as the source of resistance of the exerciser and water is less expensive than hydraulic fluid. Even if the water leaks, it is not harm the environment so that the present invention is suitable to be set in public areas such as parks.

The restriction slot 212 of the cam 21 is cooperated with the pin 28 to restrict the cam 21 to be rotated between positive and negative 58 degrees. The arms 42 that are connected to the cams 21 and the shafts 26 are restricted to be pivoted between positive and negative 58 degrees. By this arrangement, the user is not injured by overly pulling the legs.

There are multiple paths 251 defined through the piston 25, so that when the piston 25 pushes the fluid 35, the fluid 35 passes through the paths 251 of the piston 25 and flows between the top and bottom rooms 312, 313. Therefore, by the paths 251, the volume of the fluid 35 that pass through the piston 25 is increased so that the fluid 35 moves smoothly and prevents the cylinder 31 from being damaged by high pressure.

While we have shown and described the embodiment in accordance with the present invention, it should be clear to those skilled in the art that further embodiments may be made without departing from the scope of the present invention.

What is claimed is:

1. A lower body reciprocating exerciser, comprising:

a frame having two posts on two sides thereof;

two transmission units each having a cam which is a disk cam, a guide slot defined in a first face of the cam and a passive member located in the guide slot, the passive member connected with a first end of a piston rod, a piston connected to a second end of the piston rod, a shaft extending through the cam and connected to the post corresponding thereto;

two resistance units connected to the two transmission units respectively, each of the resistance units having a cylinder which has a space defined therein, the piston and the piston rod located in the space of the cylinder corresponding thereto, the piston dividing the space into a top room and a bottom room, an enclosed loop pipe connected to outside of each of the cylinders, a top pipe connected between a top portion of the loop pipe and the top room of the cylinder, a bottom pipe connected between a lower portion of the loop pipe and the bottom room of the cylinder, the loop pipe having a down-flow section and an up-flow section, each of the down-flow section and the up-flow section having a check valve and an adjustable control valve, the check valve in the down-flow section and the check valve in the up-flow section being installed in opposite directions, water being filled in the space of the cylinder, and two swing units each having a pedal and an arm, the pedal connected to a lower end of the arm, a top end of the arm pivotably connected to a first end of the shaft of the transmission unit at the post corresponding thereto.

2. The exerciser as claimed in claim 1, wherein the piston of each resistance unit has multiple paths defined therethrough.

3. The exerciser as claimed in claim 1, wherein each of the cams has a restriction slot defined in a second face thereof which is located in opposite to the first face, a pin is connected to the post and inserted into the restriction slot.

4. The exerciser as claimed in claim 3, wherein an angle of 116 degrees is defined between two extensions of the restriction slot which is a curved slot.

5. The exerciser as claimed in claim 3, wherein the frame has a base and two side frames are connected to two sides of the base, the two posts respectively extend from the two sides of the base, two installation units are respectively connected to a top end of the post and a top end of the side frame on each of the two sides of the base, each installation unit has a connection slot and the cam of the transmission unit is located in the connection slot, a passage is defined through each of the installation units and communicates with the connection slot, the shaft extends through the passage and the cam, a stop is connected to a second end of the shaft, the first end of the shaft is connected to the top end of the arm of the swing unit corresponding thereto, the installation unit has an insertion hole defined in an outer face thereof and the insertion hole communicates with the connection slot, the pin in the restriction slot of the cam is inserted into the insertion hole of the installation unit.

6. The exerciser as claimed in claim 5, wherein a handle is connected between the two side frames.

7. The exerciser as claimed in claim 1, wherein the guide slot of the each of the cams is shaped as a semi-oval curve.

8. The exerciser as claimed in claim 1, wherein the check valve and the adjustable control valve in the down-flow section of each of the resistance units are arranged such that the check valve is located above the adjustable control valve, the check valve and the adjustable control valve in the up-flow section of each of the resistance units are arranged such that the adjustable control valve is located above the check valve.

9. The exerciser as claimed in claim 1, wherein each of the posts of the frame is a hollow post and has a space defined therein, the piston rod and the piston of the transmission unit, and the resistance unit are located in the space of the post, an opening is defined through a wall of the post and communicates with the space of the post, the resistance unit is located in the opening.

10. The exerciser as claimed in claim 1, wherein the frame has a base and two side frames are connected to two sides of the base, the two posts respectively extend from the two sides of the base, two installation units are respectively connected to a top end of the post and a top end of the side frame on each of the two sides of the base, each installation unit has a connection slot and the cam of the transmission unit is located in the connection slot, a passage is defined through each of the installation units and communicates with the connection slot, the shaft extends through the passage and the cam, a stop is connected to a second end of the shaft, the first end of the shaft is connected to the top end of the arm of the swing unit corresponding thereto.

* * * * *